US009137876B2

(12) United States Patent
Chung

(10) Patent No.: US 9,137,876 B2
(45) Date of Patent: Sep. 15, 2015

(54) LIGHTING SYSTEM WITH REDUCED STANDBY POWER

(71) Applicant: LG INNOTEK CO., LTD., Seoul (KR)

(72) Inventor: Won Suk Chung, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 293 days.

(21) Appl. No.: 13/901,141

(22) Filed: May 23, 2013

(65) Prior Publication Data

US 2013/0320866 A1 Dec. 5, 2013

(30) Foreign Application Priority Data

May 31, 2012 (KR) ..... 10-2012-0058891

(51) Int. Cl.

| | |
|---|---|
| ***H05B 37/00*** | (2006.01) |
| ***H05B 39/00*** | (2006.01) |
| ***H05B 37/02*** | (2006.01) |
| ***H05B 33/08*** | (2006.01) |

(52) U.S. Cl.
CPC ..... *H05B 37/02* (2013.01); *H05B 33/0806* (2013.01); *H05B 37/0272* (2013.01)

(58) Field of Classification Search
USPC ..... 315/160, 171, 200
See application file for complete search history.

(56) References Cited

U.S. PATENT DOCUMENTS

| | | | | |
|---|---|---|---|---|
| 5,714,845 | A * | 2/1998 | Heering et al. | 315/174 |
| 2008/0157685 | A1 | 7/2008 | Tong et al. | |
| 2010/0082193 | A1* | 4/2010 | Chiappetta | 701/24 |
| 2010/0270934 | A1* | 10/2010 | Breuer et al. | 315/160 |
| 2010/0327766 | A1* | 12/2010 | Recker et al. | 315/291 |
| 2011/0043122 | A1* | 2/2011 | Alexandrov | 315/246 |
| 2011/0133655 | A1* | 6/2011 | Recker et al. | 315/159 |
| 2012/0025608 | A1 | 2/2012 | Melanson et al. | |
| 2012/0104962 | A1* | 5/2012 | Chen et al. | 315/228 |
| 2012/0280637 | A1* | 11/2012 | Tikkanen et al. | 315/294 |
| 2012/0293783 | A1* | 11/2012 | Ishida et al. | 355/67 |
| 2013/0257293 | A1* | 10/2013 | Aurongzeb et al. | 315/155 |

(Continued)

FOREIGN PATENT DOCUMENTS

| | | | |
|---|---|---|---|
| KR | 10-2011-0122987 | A | 11/2011 |
| WO | WO-2009/027962 | A2 | 3/2009 |

OTHER PUBLICATIONS

European Search Report dated Oct. 6, 2014 in European Application No. 13167075.4.

(Continued)

*Primary Examiner* — Adam Houston
(74) *Attorney, Agent, or Firm* — Saliwanchik, Lloyd & Eisenschenk

(57) ABSTRACT

A lighting system with reduced standby power according to the embodiment includes a main control unit to control a lighting device; a driver to supply the control signal to the lighting device; and an AC-DC converting circuit to supply power to the driver. A method of reducing standby power according to the embodiment includes charging a standby power supply unit with power in a normal mode; checking whether a lighting off signal is transmitted and switching off a lighting, and simultaneously, shutting off the power supplied from the AC-DC converting circuit when the lighting off signal is transmitted; changing an operation mode of a lighting device from a normal mode to a standby mode; checking whether a voltage of the standby power supply unit is less than a predetermined level; and charging the standby power supply unit when the voltage is less than the predetermined level.

15 Claims, 2 Drawing Sheets

(56) References Cited

U.S. PATENT DOCUMENTS

| | | | | |
|---|---|---|---|---|
| 2013/0320866 | A1* | 12/2013 | Chung | 315/171 |
| 2014/0132160 | A1* | 5/2014 | Zhang | 315/160 |
| 2014/0268628 | A1* | 9/2014 | Mann et al. | 362/23.1 |
| 2014/0346874 | A1* | 11/2014 | Fang et al. | 307/31 |
| 2015/0035437 | A1* | 2/2015 | Panopoulos et al. | 315/112 |
| 2015/0069925 | A1* | 3/2015 | Van Der Veen et al. | 315/206 |
| 2015/0091451 | A1* | 4/2015 | Williams | 315/160 |
| 2015/0116635 | A1* | 4/2015 | Kanemitsu et al. | 349/69 |

OTHER PUBLICATIONS

Office Action dated Jul. 10, 2013 in Korean Application No. 10-2012-0058891, filed May 31, 2012.

* cited by examiner

LIGHTING SYSTEM WITH REDUCED STANDBY POWER

CROSS-REFERENCE TO RELATED APPLICATION

This application claims the benefit under 35 U.S.C. §119 of Korean Patent Application No. 10-2012-0058891, filed May 31, 2012, which is hereby incorporated by reference in its entirety.

BACKGROUND OF THE INVENTION

The embodiment relates to a lighting system with reduced standby power. More particularly, the embodiment relates to a standby power cut-off system using wireless communication.

Standby power refers to power being consumed even after a power source is switched off, that is, electric energy being continuously consumed regardless of the operation of electric appliances.

In general, a lighting device employs a dimmer to properly maintain intensity of lighting according to indoor environment and to reduce unnecessary power consumption. The dimmer is connected to the lighting device to control the on/off operation, the lighting level, and the color temperature level of the lighting device.

Recently, with the development of wireless communication technologies, a technology for collectively controlling a lighting device using a wireless dimmer from a remote place has been suggested. In this case, a control unit of a wireless dimmer must be always kept in the normal operation in order to control the operation of each lighting device, so power is unnecessarily consumed.

BRIEF SUMMARY

The embodiment provides a lighting system with reduced standby power.

A lighting system with reduced standby power according to the embodiment includes a main control unit to control a lighting device according to a control signal; a driver connected to the main control unit to supply the control signal to the lighting device; and an AC-DC converting circuit to supply power to the driver, wherein the main control unit includes a lighting control unit to control the lighting device; a standby power supply unit to supply standby power; and a power control unit to maintain a voltage or a current of the standby power supply unit in a predetermined level.

A method of reducing standby power according to the embodiment includes charging a standby power supply unit with power supplied from an AC-DC converting circuit in a normal mode; checking whether a lighting off signal is transmitted from an outside and switching off a lighting, and simultaneously, shutting off the power supplied from the AC-DC converting circuit when the lighting off signal is transmitted; changing an operation mode of a lighting device from a normal mode to a standby mode; checking whether a voltage of the standby power supply unit is less than a predetermined level by sensing the voltage of the standby power supply unit; and charging the standby power supply unit when the voltage of the standby power supply unit is less than the predetermined level.

According to the embodiment, the standby power supply unit is charged by periodically checking the voltage or a current of the standby power supply unit that provides the standby power so that the standby power can be effectively reduced.

DETAILED DESCRIPTION OF THE EMBODIMENTS

The advantages, the features, and schemes of achieving the advantages and features of the disclosure will be apparently comprehended by those skilled in the art based on the embodiments, which are described below in detail, together with accompanying drawings.

Figure 1:
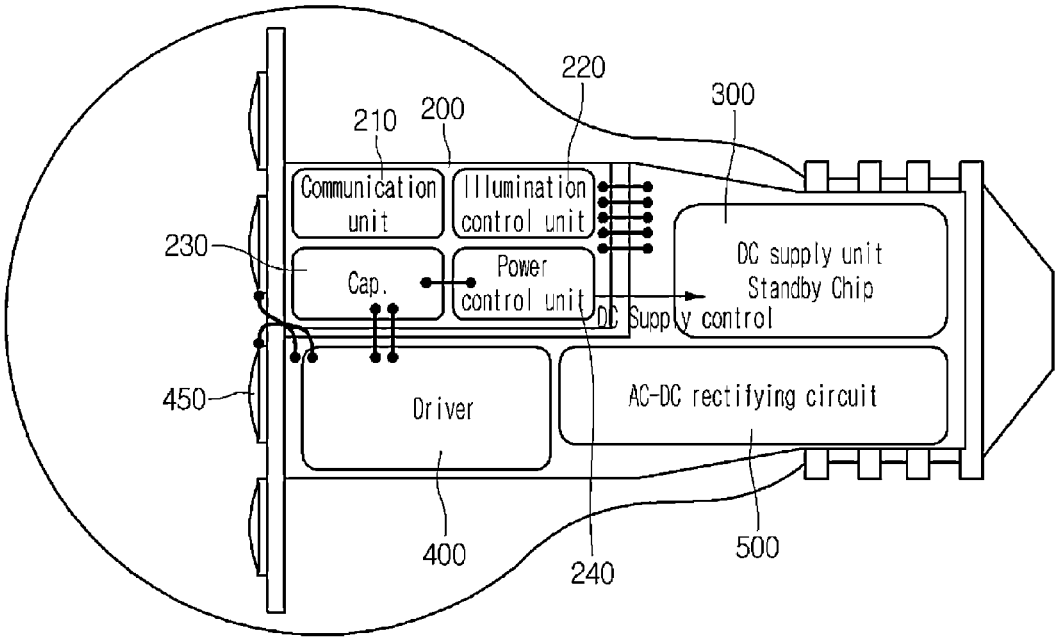
FIG. 1 is a block diagram of a lighting system according to the embodiment.

FIG. 1 is a block diagram of a lighting system according to the embodiment. Referring to FIG. 1, the lighting system 100 according to the embodiment includes a main control unit 200, a DC supply unit 300, a driver 400, a lighting 450 and an AC-DC converting circuit 500.

The embodiment is shown in FIG. 1 as a block diagram in which a diode, a condenser, a coil, a resistor, a switching device and a microprocessor constituting main components of the embodiment are omitted because the embodiment may be easily embodied by those skilled in the art based on the block diagram, so the detailed circuit diagram will be omitted.

The main control unit 200 includes a communication unit 210, a lighting control unit 220, a standby power supply unit 230 and a power control unit 240.

The communication unit 210 may perform wireless communication with external devices. For instance, when a lighting control signal, such as a lighting level signal or a color temperature level signal, is input from the outside, the communication unit 210 transfers the alighting control signal to the lighting control unit 220 to control the intensity of lighting (brightness) and the color temperature of the lighting 450 according to the lighting control signal. The wireless communication may be performed, for instance, through the radio frequency (RF) scheme.

The lighting control unit 220 is connected to the communication unit 210 to control the power supplied to the lighting 450. The lighting control unit 220 is connected to the driver 400 and transfers the lighting control signal received from the outside to the driver 400 to control the brightness and the color temperature of the lighting 450 according to the lighting control signal. The lighting control signal may be a dimming signal.

When a lighting off signal is input from the outside, the lighting control unit 220 turns off the lighting 450 by controlling the driver 400. In addition, the lighting control unit 220 changes the operation mode of the power control unit 240 to the standby mode. In the standby mode, the power control unit 240 is connected to the standby power supply unit 230 and the standby power supply unit 230 is charged for standby time by sensing the voltage of the standby power supply unit 230.

In detail, the power control unit 240 checks the voltage of the standby power supply unit 230 in a predetermined time interval and drives the DC supply unit 300 when a voltage value of the standby power supply unit 230 is lower than a predetermined value to charge the standby power supply unit 230 with the voltage supplied from the DC supply unit 300.

In this case, the power control unit 240 controls the DC supply unit 300 to operate in the normal mode from the standby mode such that the standby power supply unit 230 can be charged with the voltage having the predetermined value or more.

If the standby power supply unit 230 is charged with the voltage having the predetermined value or more, the power control unit 240 supplies a control signal to stop the operation of the DC supply unit 300 so that the operation mode of the DC supply unit 300 may be changed from the normal mode to the standby mode.

The standby power supply unit 230 is connected to the power control unit 240 and the communication unit 210 to supply standby power required for receiving the control signal from the outside to the communication unit 210. The standby power supply unit 230 may include a super capacitor.

The DC supply unit 300 is connected to the AC-DC converting circuit 500 to use DC power output from the AC-DC converting circuit 500 so that the standby power supply unit 230 can be charged without a separate driving power source.

If the feeding time of the standby power is set to the standby time or below according to the capacitance of the capacitor included in the standby power supply unit 230, the standby power can be supplied by sensing the voltage in a predetermined time interval as described above when the power is supplied.

The driver 400 is connected to the lighting 450 to supply power to the lighting 450. If necessary, the user can adjust the brightness of the lighting 450 by controlling the power supplied to the lighting 450.

The lighting 450 may include a light emitting diode LED, but the embodiment is not limited thereto.

The AC-DC converting circuit 500 converts input AC power into DC power and transfers the DC power to the driver 400 and may include a diode.

The standby power supply unit 230 and the power control unit 240 may be integrally formed with each other in the lighting system 100.

As described above, the voltage of the standby power supply unit 230 can be maintained in a predetermined level or more by sensing the voltage of the standby power supply unit 230 in a predetermined time interval even when the operation is finished as well as in the normal operation mode, so that the consumption of the standby power may be reduced even if the power source for the lighting 450 is switched off.

Figure 2:
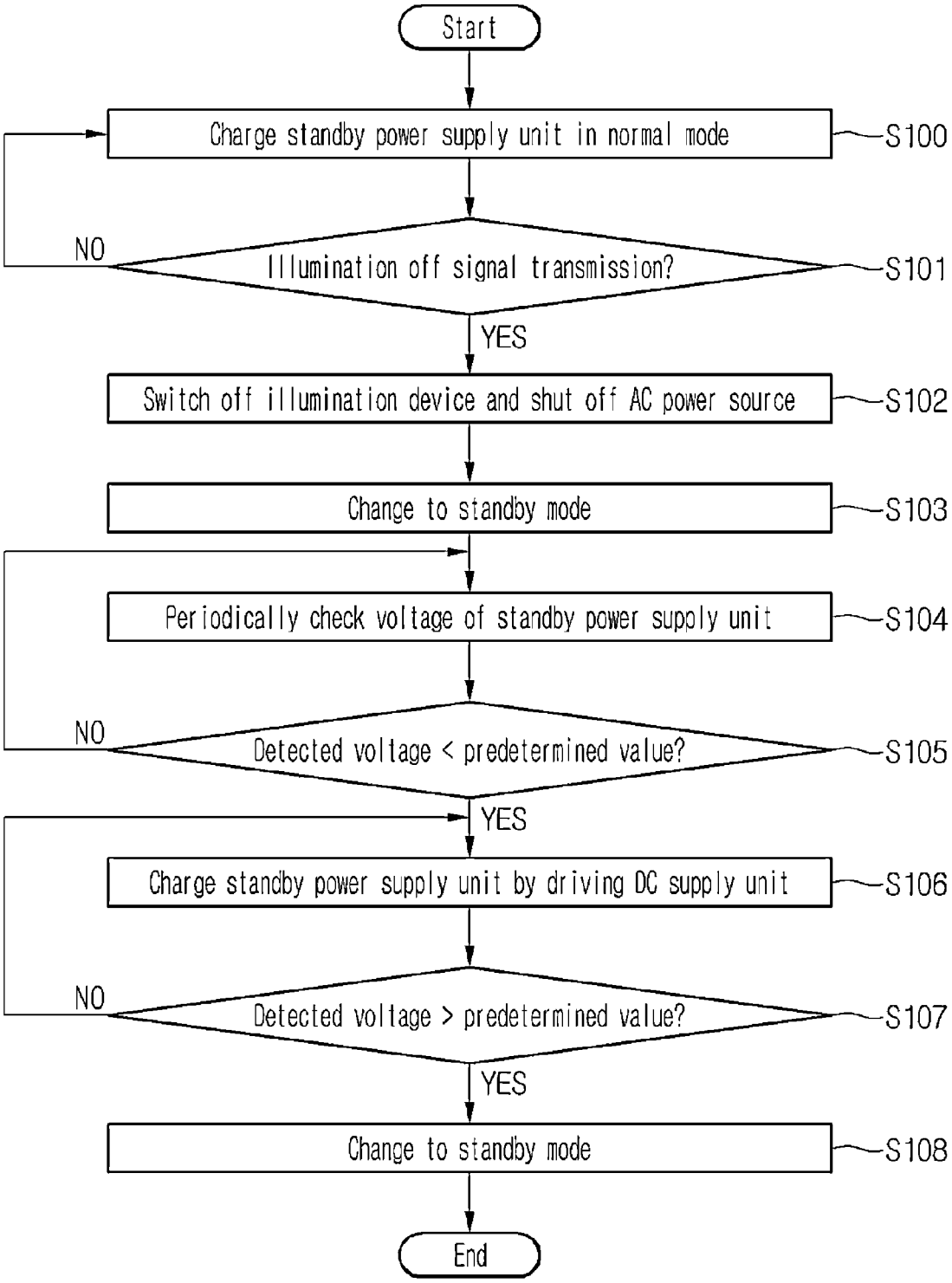
FIG. 2 is a flowchart showing a method of reducing standby power of a lighting system according to the embodiment.

FIG. 2 is a flowchart showing a method of reducing standby power of the lighting system according to the embodiment.

Referring to FIG. 2, in the normal mode, the power supplied from the AC-DC converting circuit 500 is charged in the standby power supply unit 230 (S100). At this time, the power supplied from the AC-DC converting circuit 500 is also supplied to the driver 400.

Then, the communication unit 210 determines whether the lighting off signal is transmitted from the outside (S101). If the lighting off signal is transmitted from the outside, the lighting 450 is switched off through the lighting control unit 220 and the power supplied from the AC-DC converting circuit 500 is shut off (S102).

After that, the lighting control unit 220 changes the operation mode of the lighting device from the normal mode to the standby mode (S103). If the operation mode of the lighting device is changed to the standby mode, the communication unit 210 receives the standby power from the standby power supply unit 230.

Then, the power control unit 240 periodically checks the voltage of the standby power supply unit 230 (S104).

Next, it is checked whether the voltage of the standby power supply unit 230 is less than the predetermined value (S105).

If it is determined in step S105 that the voltage of the standby power supply unit 230 is less than the predetermined value, the power control unit 240 changes the operation mode of the DC supply unit 300 from the standby mode to the normal mode to charge the standby power supply unit 230 (S106).

That is, when the operation mode of the lighting system 100 is the standby mode, the voltage state of the standby power supply unit 230 is periodically checked and the operation mode of the DC supply unit 300 is changed from the standby mode to the normal mode when the voltage of the standby power supply unit 230 is less than the predetermined value in order to charge the standby power supply unit 230.

After that, the power control unit 240 checks whether the voltage of the standby power supply unit 230 is more than the predetermined level (S107). If the voltage of the standby power supply unit 230 is more than the predetermined level, the operation mode of the DC supply unit 300 is changed again to the standby mode (S108).

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting system with reduced standby power, the lighting system comprising:

a main control unit to control a lighting device according to a control signal;

a driver connected to the main control unit to supply the control signal to the lighting device; and an AC-DC converting circuit to supply power to the driver, wherein the main control unit comprises:

a lighting control unit to control the lighting device;

a standby power supply unit to supply standby power; and a power control unit to maintain a voltage or a current of the standby power supply unit in a predetermined level.

2. The lighting system of claim 1, wherein the main control unit comprises a communication unit to receive the control signal from an outside.

3. The lighting system of claim 2, wherein the communication unit operates in a radio frequency (RF) scheme.

4. The lighting system of claim 1, wherein the standby power supply unit comprises a super capacitor.

5. The lighting system of claim 1, further comprising a DC supply unit connected to the AC-DC converting circuit to supply power to the standby power supply unit.

6. The lighting system of claim 1, wherein the power control unit checks the voltage of the standby power supply unit in a predetermined time interval.

7. The lighting system of claim 6, wherein the power control unit drives the DC supply unit to charge the standby power supply unit when the voltage of the standby power supply unit is less than a predetermined range.

8. The lighting system of claim 7, wherein the standby power supply unit and the power control unit are integrally formed with each other in the lighting system.

9. The lighting system of claim 1, wherein the lighting device comprises a light emitting diode (LED).

10. A method of reducing standby power, the method comprising:

charging a standby power supply unit with power supplied from an AC-DC converting circuit in a normal mode;

checking whether a lighting off signal is transmitted from an outside and switching off a lighting, and simultaneously, shutting off the power supplied from the AC-DC converting circuit when the lighting off signal is transmitted;

changing an operation mode of a lighting device from a normal mode to a standby mode;

checking whether a voltage of the standby power supply unit is less than a predetermined level by sensing the voltage of the standby power supply unit; and charging the standby power supply unit when the voltage of the standby power supply unit is less than the predetermined level.

11. The method of claim 10, wherein the checking of the voltage of the standby power supply unit comprises changing an operation mode of a DC supply unit to a standby mode when the voltage of the standby power supply unit is equal to or higher than the predetermined level.

12. The method of claim 11, wherein the charging of the standby power supply unit comprises charging the standby power supply unit with the voltage received from the DC supply unit.

13. The method of claim 12, wherein the standby power supply unit comprises a super capacitor.

14. The method of claim 13, wherein the sensing of the voltage of the standby power supply unit comprises sensing the voltage of the standby power supply unit in a predetermined time interval.

15. The method of claim 14, wherein the lighting off signal is received from the outside through a wireless communication.

* * * * *